US008671960B2

(12) United States Patent
Kan et al.

(10) Patent No.: US 8,671,960 B2
(45) Date of Patent: Mar. 18, 2014

(54) DETERGENT DISPENSER WITH AGITATOR CURRENT DETERMINING FILL LEVEL

(75) Inventors: Ugur Kan, Istanbul (TR); Ufuk Askin, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 881 days.

(21) Appl. No.: 12/513,120

(22) PCT Filed: Oct. 31, 2007

(86) PCT No.: PCT/EP2007/061718
§ 371 (c)(1),
(2), (4) Date: May 11, 2010

(87) PCT Pub. No.: WO2008/053003
PCT Pub. Date: May 8, 2008

(65) Prior Publication Data

US 2010/0212704 A1 Aug. 26, 2010

(30) Foreign Application Priority Data

Oct. 31, 2006 (TR) ..... a 2006 06042

(51) Int. Cl.
*B08B 3/00* (2006.01)

(52) U.S. Cl.
USPC ..... 134/93

(58) Field of Classification Search
USPC ..... 68/3 SS, 17 R; 134/93, 184
See application file for complete search history.

(56) References Cited

U.S. PATENT DOCUMENTS

| | | | | | |
|---|---|---|---|---|---|
| 3,019,650 | A | * | 2/1962 | Worswick | 73/290 V |
| 3,033,423 | A | * | 5/1962 | Anderson et al. | 222/161 |
| 3,315,429 | A | * | 4/1967 | Swanson | 52/506.1 |
| 3,851,798 | A | * | 12/1974 | Miller | 222/135 |
| 4,785,663 | A | * | 11/1988 | Hermann | 73/290 V |
| 5,247,832 | A | * | 9/1993 | Umezawa et al. | 73/290 V |
| 5,417,233 | A | * | 5/1995 | Thomas et al. | 134/93 |
| 5,857,589 | A | * | 1/1999 | Cline et al. | 222/1 |
| 6,105,425 | A | * | 8/2000 | Kawakatsu | 73/290 V |
| 7,065,940 | B2 | * | 6/2006 | Dudek et al. | 53/473 |

FOREIGN PATENT DOCUMENTS

| | | | |
|---|---|---|---|
| JP | 55-121147 | * | 9/1980 |
| JP | 56-150771 | * | 11/1981 |
| JP | 2004-251823 | * | 9/2004 |

* cited by examiner

*Primary Examiner* — David Cormier
(74) *Attorney, Agent, or Firm* — Venable, Campillo, Logan & Meaney PC

(57) ABSTRACT

The present invention relates to a washer (1) comprising a dosing unit (4). In the said washer (1), the current supplied to the agitator motor (8) actuating the agitator (6) disposed inside the receptacle (5) of the dosing unit (4), preferably at the base embedded in the cleaning agent, is monitored, in order to determine a fill level of the dosing unit (4) by comparing the supplied current to stored current levels for known fill levels.

14 Claims, 4 Drawing Sheets

DETERGENT DISPENSER WITH AGITATOR CURRENT DETERMINING FILL LEVEL

Figure 1:
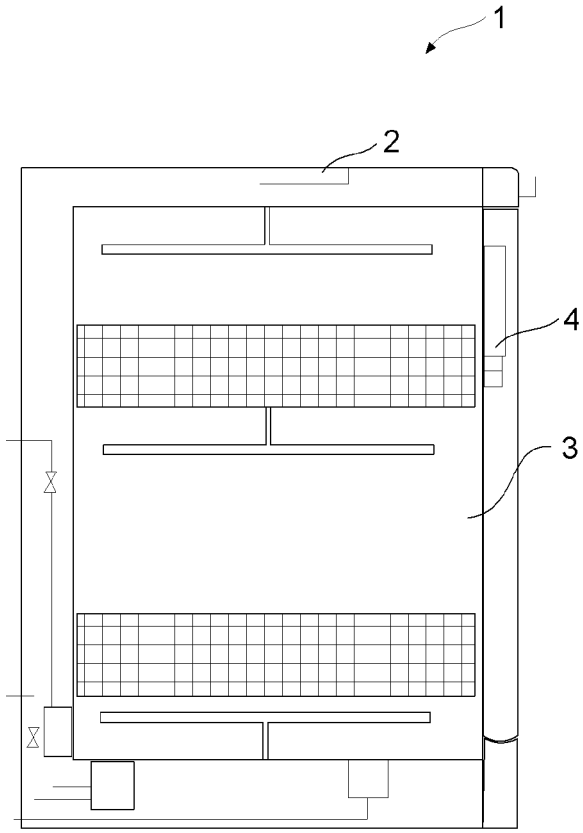

The present invention relates to a washer that comprises a dosing unit.

Washers such as washing machines or dishwashers are utilized for cleaning the laundry and dishes with the help of cleaning agents. In particularly the dishwashers, a washing program is employed comprising the various steps of pre-washing, main washing, and rinsing.

In this type of machines, the user has to refill in the receptacle with cleaning agents for each washing process. In case the user forgets to place the cleaning agent in the receptacle or places less than sufficient it results in the dishes not being cleaned or at least the washing performance to decrease. In case more than enough cleaning agent is placed, it results in the pollution of the environment and the rinsing to be inadequate. Dosing units have been developed in order to solve this and similar problems. Cleaning agents that is required for multiple numbers of washing is filled in the receptacles of these units. The cleaning agent for one washing is automatically taken from this receptacle by a dosing means and transferred to the receptacle or directly to the tub.

In state of the art dosing units, it is observed that the powder cleaning agent becomes lumpy and solidifies in time because the water, humidity and/or the vapor in the tub passes from the dispenser and reaches to the receptacle. In this case, the cleaning agent cannot be dosed in the correct amount. An agitator is disposed in the receptacle to solve this problem in state of the art dosing units.

In state of the art applications, a dedicated sensor has to be used to find out whether or not detergent is present in the receptacle. The sensors detect whether or not detergent is present by monitoring the changes in various physical variables. However, since these are stationary devices, detergent may accumulate thereon and in time the precision is perceived to diminish. Moreover, when particularly optical sensors are used, the particles of cleaning agent that adhere to the optical sensor may cause the sensor to become dysfunctional.

In the Japanese Patent Application No JP60004820 and the U.S. Pat. No. 4,107,994, a level sensor is described that is disposed on the side wall of the container. These sensors comprise a diaphragm that is at the same surface level with the wall.

The aim of the present invention is the realization of a washer comprising an economic dosing unit that functions more effectively.

The washer realized in order to attain the aim of the present invention is explicated in the attached claims. In the said washer, the amount of the detergent is ascertained by monitoring the current supplied to the agitator motor that actuates an agitator disposed in the receptacle of the dosing unit, preferably at the base, embedded in the cleaning agent.

When the receptacle is full, the current supplied to the agitator motor is more since the agitator disposed under the heap of the cleaning agent is strained to move. As the cleaning agent decreases, the agitator starts moving more easily and the current supplied to the agitator motor decreases. The magnitude of the current can be used in determining the amount of cleaning agent left in the receptacle. When this current goes below a certain limit determined by the producer, it is ascertained that the cleaning agent in the receptacle has either decreased a lot or finished. Consequently, it can be determined what amount of cleaning agent is left in the receptacle by only monitoring the current supplied to the agitator motor present therein without using a dedicated sensor. The amount of the cleaning agent in the receptacle is displayed for the user by means of an indicator or a visual alerter and/or the agitator is stopped when the amount falls below a certain limit value. Since the agitator is a movable component, detergent does not accumulate thereon.

In an embodiment of the present invention, the agitator is configured as a hollow cantilever beam in a place at the vicinity of the base, extending from the wall of the receptacle to the center. While one end of the beam is secured on the wall, the other end is free. The agitator motor disposed inside the beam rotates an axially offset protrusion fitted on the outlet thereof in the void inside the beam. Since the protrusion is not coaxial with the beam, the agitator motor causes the beam to vibrate. This vibration prevents the powder type cleaning agents wherein the beam is embedded from getting lumpy. When there is sufficient amount of cleaning agent in the receptacle, some portion of the beam vibration is attenuated. As the amount of the cleaning agent in the receptacle decreases, the beam vibrates more and the agitator motor draws less current. When the supplied current falls below a certain value, it is interpreted that an insufficient amount of cleaning agent is left in the receptacle. In this embodiment, since the agitator is configured as a straight beam without any recesses or protrusions, the possibility of the cleaning agent adhering thereto is quite low.

The washer realized in order to attain the aim of the present invention is illustrated in the attached figures, where:

FIG. 1—is the schematic view of a washer.

Figure 2:
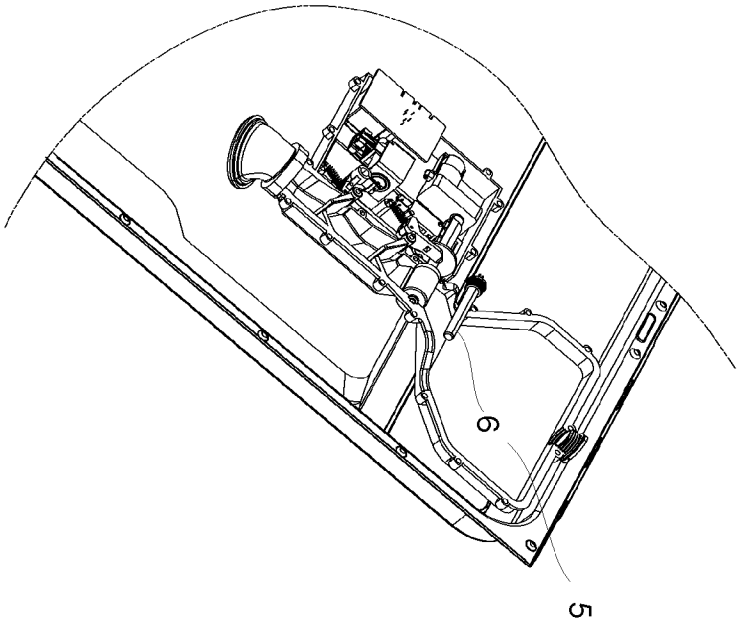

FIG. 2—is the perspective view of the dosing unit.

Figure 3:
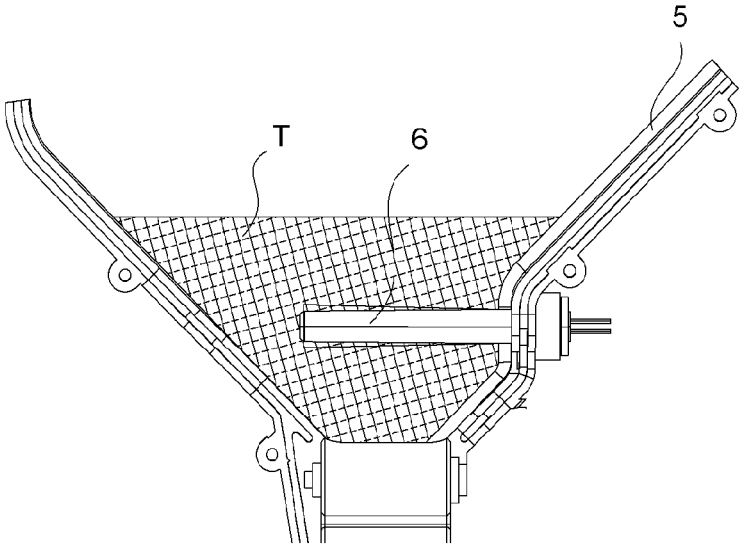

FIG. 3—is the schematic view of the dosing unit when the receptacle is full.

Figure 4:
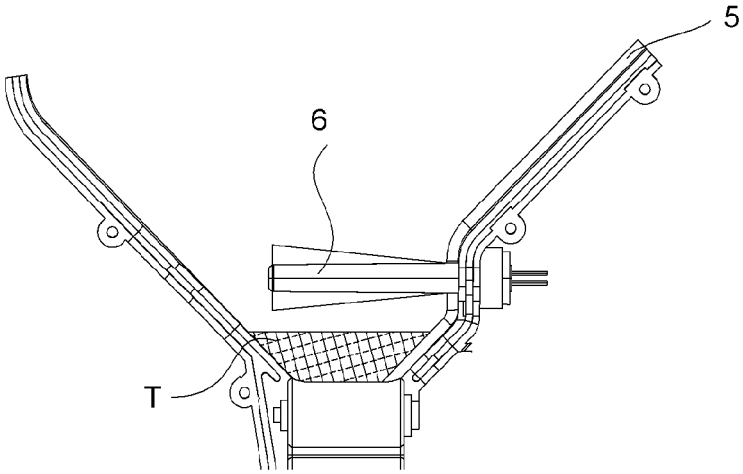

FIG. 4—is the schematic view of the dosing unit when the receptacle is empty.

Figure 5:
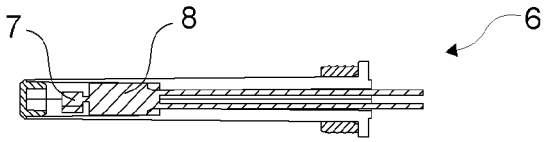

FIG. 5—is the cross-sectional view of the agitator.

The elements illustrated in the figures are numbered as follows:

1. Washer
2. Control unit
3. Tub
4. Dosing unit
5. Receptacle
6. Agitator
7. Protrusion
8. Agitator motor The washer (1) is a washing machine used for cleaning laundry or a dishwasher for washing dishes.

The washer (1) comprises a tub (3) wherein the items to be washed are emplaced, a dosing unit (4) for dispensing the required amount of cleaning agent into the tub (3), and a control unit (2) (FIG. 1).

The dosing unit (4) comprises a receptacle (5) wherein the cleaning agent required for more than one washing is emplaced, an agitator (6) disposed in this receptacle (5) that prevents the flaking of the cleaning agent (T) present in the receptacle (5) by moving and an agitator motor (8) that supplies the required drive for the motion of the agitator (6).

In the washer (1), the subject of the present invention, the control unit (2) monitors the current supplied to the agitator motor (8). The current magnitudes of the agitator motor (8) corresponding to certain amounts or levels of cleaning agent are recorded in the control unit (2) by the producer. The control unit (2) compares the magnitude of the current supplied to the agitator motor (8) with the agitator motor (8) current magnitudes recorded by the producer to determine the amount or level of the cleaning agent (T) present at that moment in the receptacle (5). When the current exceeds a limit preset by the producer, the control unit (2) decides that the receptacle (5) does not contain a sufficient amount of cleaning agent (T) (FIG. 2).

In this embodiment, the weight of the cleaning agent exerts pressure on the agitator (6) when the receptacle (5) is full since the agitator (6) is disposed in a place near the base of the receptacle (5) (FIG. 2). Therefore, the agitator motor (8) is strained to revolve and draws a high current. The dosing unit (4) delivers a certain amount of the cleaning agent into the tub (3) at each washing. Consequently, the amount of the cleaning agent in the receptacle (5) is gradually decreasing from one washing program to another. The decrease in the amount of the cleaning agent and hence the pressure exerted on the agitator (6), facilitates the motion of the agitator (6) and the rotation of the agitator motor (8). An easily rotating agitator motor (8) gradually draws less current. In other words, there is a reverse proportion between the amount of the cleaning agent in the receptacle (5) and the current supplied to the agitator motor (8). When the current supplied to the agitator motor (8) falls below a certain limit, it is decided that the amount of cleaning agent in the receptacle (5) is less than required for performing one washing.

In another embodiment of the present invention, the agitator (6) is configured as a hollow cylinder that is secured from one end to a wall of the receptacle (5). The agitator (6) preferably extends in a horizontal direction and is moved by vibrating. Thus the cleaning agent in the receptacle (5) exerts pressure along the whole length of the agitator (6). The agitator motor (8) is disposed in the void inside the agitator (6) (FIG. 5). The required electrical connections for feeding the agitator motor (8) are preferably passed through the end of the agitator (6) secured on the wall of the receptacle (5). In this embodiment, the dosing unit (4) furthermore comprises a protrusion (7) inside the agitator (6) fastened axially offset to the outlet of the agitator motor (8). When electric is delivered to the agitator motor (8), the protrusion (7) starts rotating inside the agitator (6). The unbalanced position of the protrusion (7) with respect to the outlet of the motor (8) vibrates the agitator (6) inside the receptacle (5).

In this embodiment, the vibration of the agitator (6) prevents the cleaning agent in which it is embedded from becoming flaked and solidified. If there is cleaning agent in the receptacle (5), then the vibration amplitude of the agitator (6) is low. However, if the cleaning agent is less, the vibration amplitude is greater. Therefore as the cleaning agent decreases, the agitator motor (8) draws less current. In this embodiment, the agitator (6) is produced with a very simple geometry thus providing production and usage facility. Moreover, since the agitator (6) does not have a rotating incisive component such as fins or vanes, the user will not be harmed even if he/she inserts a hand into the receptacle (5) while the agitator (6) functions.

In this embodiment, the greatest vibration amplitude occurs at the tip of the agitator (6). Therefore, the agitator (6) is positioned at such a level that the wobbling tip will not collide the base of the receptacle (5). In a way, the agitator (6) is as close to the base of the receptacle (5) as possible but as distant as to not be damaged from colliding. Consequently, the depletion of the cleaning agent can be measured more accurately.

In an embodiment of the present invention, the control unit (2) informs the user that the cleaning agent is finished with an audio and/or visual alert when the current goes below a threshold determined by the producer. By this means, the washer (1) is prevented from functioning without any cleaning agent present.

In another embodiment of the present invention, the control unit (2) cuts off the current supplied to the agitator motor (8) when the current goes below a threshold determined by the producer, preventing the agitator (6) from making noise in the empty receptacle (5).

By means of the present invention, both the amount of the cleaning agent is determined and the flaking is prevented without requiring a complex mechanism. Consequently, cost savings is provided.

The invention claimed is:

1. A washer (1) used for cleaning items by washing, comprising a tub (3) wherein the items to be washed are emplaced, and a dosing unit (4) for dispensing a required amount of a cleaning agent into the tub (3) for washing, having a receptacle (5) wherein the cleaning agent required for more than one washing is emplaced, an agitator (6) disposed in this receptacle (5) that prevents flaking of the cleaning agent (T) present in the receptacle (5) by moving and an agitator motor (8) that drives the motion of the agitator (6), and a control unit (2) configured to record agitator motor (8) current magnitudes corresponding to certain amounts of the cleaning agent, to determine an amount of the cleaning agent (T) present in the receptacle (5) at a certain moment by monitoring a current supplied to the agitator motor (8) and comparing the magnitude of the supplied current with the recorded agitator motor current magnitudes, and wherein the agitator is a hollow cylinder having the agitator motor disposed therein.

2. The washer (1) as in claim 1, wherein the agitator is secured from one end to a wall of the receptacle (5) with another end being free, extending in a horizontal direction and moved by vibrating.

3. The washer (1) as in claim 2, wherein the agitator motor (8) has electrical connections passed through the end of the agitator (6) secured on the wall of the receptacle (5).

4. The washer (1) as in claim 3, wherein the dosing unit (4) comprises a protrusion (7) fastened axially offset to an outlet of the agitator motor (8) inside the agitator (6).

5. The washer as in claim 4, wherein the control unit (2) informs a user that the cleaning agent is finished with an audio and/or visual alert when the supplied current goes below a determined threshold.

6. The washer (1) as in claim 5, wherein the control unit (2) cuts off the current supplied to the agitator motor (8) when the supplied current goes below the determined threshold.

7. The washer (1) as in claim 4, wherein the control unit (2) cuts off the current supplied to the agitator motor (8) when the supplied current goes below a determined threshold.

8. The washer (1) as in claim 3, wherein the control unit (2) cuts off the current supplied to the agitator motor (8) when the supplied current goes below a determined threshold.

9. The washer (1) as in claim 3, wherein the control unit (2) informs a user that the cleaning agent is finished with an audio and/or visual alert when the supplied current goes below a determined threshold.

10. The washer (1) as in claim 2, wherein the control unit (2) cuts off the current supplied to the agitator motor (8) when the supplied current goes below a determined threshold.

11. The washer (1) as in claim 2, wherein the control unit (2) informs a user that the cleaning agent is finished with an audio and/or visual alert when the supplied current goes below a determined threshold.

12. The washer (1) as in claim 2, wherein the dosing unit (4) comprises a protrusion (7) fastened axially offset to an outlet of the agitator motor (8) inside the agitator (6).

13. The washer (1) as in claim 1, wherein the control unit (2) cuts off the current supplied to the agitator motor (8) when the supplied current goes below a determined threshold.

14. The washer (1) as in claim 1, wherein the control unit (2) informs a user that the cleaning agent is finished with an audio and/or visual alert when the supplied current goes below a determined threshold.

* * * * *